US010289026B2

(12) United States Patent
Nohara et al.

(10) Patent No.: US 10,289,026 B2
(45) Date of Patent: May 14, 2019

(54) IMAGE FORMING APPARATUS

(71) Applicant: KYOCERA Document Solutions Inc., Osaka-shi (JP)

(72) Inventors: Yuta Nohara, Osaka (JP); Tomohiko Yamakawa, Osaka (JP); Hiroaki Ohashi, Osaka (JP); Masaru Takagi, Osaka (JP)

(73) Assignee: Kyocera Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/127,774

(22) Filed: Sep. 11, 2018

(65) Prior Publication Data

US 2019/0086835 A1 Mar. 21, 2019

(30) Foreign Application Priority Data

Sep. 21, 2017 (JP) ..... 2017-181107

(51) Int. Cl.
*G03G 15/08* (2006.01)
*G03G 15/16* (2006.01)

(52) U.S. Cl.
CPC ..... *G03G 15/0868* (2013.01); *G03G 15/0887* (2013.01); *G03G 15/1615* (2013.01)

(58) Field of Classification Search
CPC ..... G03G 15/0868; G03G 15/0887; G03G 15/1615; G03G 21/1647; G03G 21/10; G03G 15/831; G03G 15/0867
See application file for complete search history.

(56) References Cited

U.S. PATENT DOCUMENTS 6,091,912 A * 7/2000 Kitajima ..... G03G 15/0872 399/119
6,151,471 A * 11/2000 Yahata ..... G03G 15/0822 399/258
9,360,816 B1 * 6/2016 Mabuchi ..... G03G 15/55
2003/0152394 A1 * 8/2003 Nakase ..... G03G 15/0896 399/27
2016/0202660 A1 * 7/2016 Terai ..... G03G 21/1647 399/110
2016/0259286 A1 * 9/2016 Akiba ..... G03G 15/55

FOREIGN PATENT DOCUMENTS

JP 2014-157350 8/2014

* cited by examiner

*Primary Examiner* — Francis C Gray
(74) *Attorney, Agent, or Firm* — Gerald E. Hespos; Michael J. Porco; Matthew T. Hespos

(57) ABSTRACT

An image forming unit of an image forming apparatus includes a developing device and a toner replenishing unit that replenishes the developing device with toner. The toner replenishing unit includes an upper toner container, a lower toner container, a toner conveyance unit, and a replenishment control unit. The upper toner container and the lower toner container are disposed adjacently to each other in a vertical direction in an apparatus body. When the upper toner container becomes empty, the replenishment control unit controls the toner replenishing unit so as to replenish the developing device with the toner from the lower toner container.

7 Claims, 12 Drawing Sheets

IMAGE FORMING APPARATUS

INCORPORATION BY REFERENCE

This application is based on Japanese Patent Application No. 2017-181107 filed on Sep. 21, 2017 in the Japan Patent Office, the contents of which are incorporated by reference.

BACKGROUND

The present disclosure relates to an image forming apparatus for forming an image on a sheet.

Conventionally, an image forming apparatus that employs an electrophotographic method such as a printer and a copying machine includes a photoreceptor drum that supports an electrostatic latent image, a developing device that supplies the photoreceptor drum with toner to visualize the electrostatic latent image in a toner image, and a transfer device that transfers the toner image from the photoreceptor drum to a sheet.

An image forming apparatus including a plurality of developing devices corresponding to color toners of respective colors in which two toner containers for supplying each developing device with replenishing toner are disposed is known. Even when one of the toner containers becomes empty, it is possible to replenish the toner from the other toner container. This will shorten forced stop time (non-printable time) of the image forming apparatus. Particularly, when a print job including a large number of printing sheets is executed, it is possible to prevent the job from being interrupted halfway because the image forming apparatus is out of toner.

SUMMARY

An image forming apparatus according to an aspect of the present disclosure includes: an apparatus body; at least one image forming unit configured to form a toner image; and a transfer unit configured to transfer the toner image onto a sheet. The image forming unit includes a photoreceptor drum, a developing device, and a toner replenishing unit. The photoreceptor drum is rotated about a predetermined axis and has a peripheral surface that allows formation of an electrostatic latent image and supports a toner image corresponding to the electrostatic latent image. The developing device supplies the photoreceptor drum with toner to visualize the electrostatic latent image in the toner image. The developing device includes a toner replenishing port for internally receiving the toner. The toner replenishing unit is disposed above the developing device and replenishes the developing device with the toner through the toner replenishing port. The toner replenishing unit includes a first toner container, a second toner container, a first container mounting unit, a second container mounting unit, a toner conveyance unit, and a replenishment control unit. The first toner container extends along an axial direction of the photoreceptor drum, and can store and discharge the toner. The second toner container extends along the axial direction, and can store and discharge the toner. The first container mounting unit is disposed with a space above the developing device in the apparatus body. The first container mounting unit allows the first toner container to be mounted along the axial direction, and receives the first toner container. The second container mounting unit is disposed above the developing device and below the first container mounting unit in the apparatus body. The second container mounting unit allows the second toner container to be mounted along the axial direction and receives the second toner container. The toner conveyance unit conveys the toner discharged from the first toner container mounted in the first container mounting unit and the second toner container mounted in the second container mounting unit to the developing device. The replenishment control unit controls the toner conveyance unit such that one toner container of the first toner container and the second toner container supplies the developing device with the toner, and when the one toner container becomes empty, another toner container of the first toner container and the second toner container supplies the developing device with the toner.

DETAILED DESCRIPTION

An image forming apparatus 10 according to an embodiment of the present disclosure will be described in detail below with reference to the drawings. As one example of the image forming apparatus, the present embodiment illustrates a tandem color printer. The image forming apparatus may be, for example, a copying machine, a facsimile, a multifunction machine of these machines, or the like. The image forming apparatus may be a printer, a copying machine, or the like that forms a monochrome image.

Figure 1:
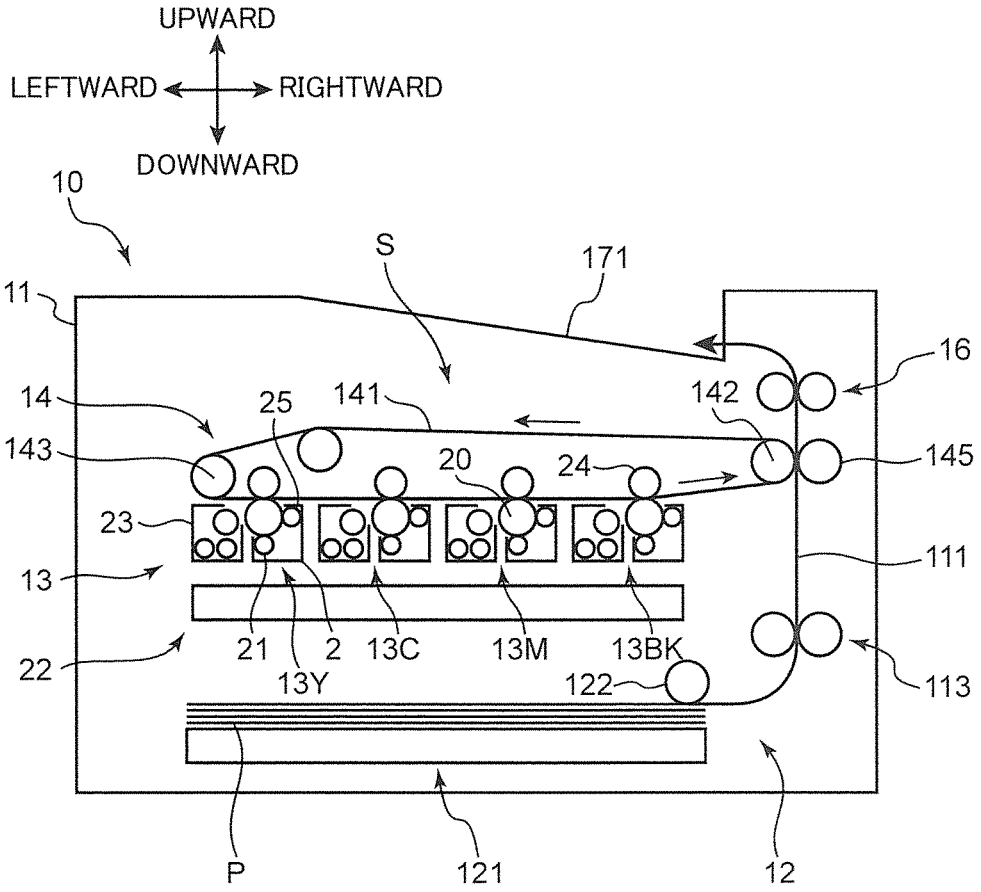
FIG. 1 is a cross-sectional view showing an internal structure of an image forming apparatus according to an embodiment of the present disclosure.

FIG. 1 is a cross-sectional view showing an internal structure of the image forming apparatus 10. The image forming apparatus 10 includes an apparatus body 11 having a box-shaped housing structure. In this apparatus body 11, a sheet feeding unit 12 that feeds a sheet P, an image forming unit 13 that forms a toner image to be transferred onto the sheet P fed from the sheet feeding unit 12, an intermediate transfer unit 14 to which the toner image is primarily transferred, a secondary transfer roller 145, and a fixing unit 16 that performs a process of fixing, onto the sheet P, an unfixed toner image formed on the sheet P are installed. Furthermore, on an upper portion of the apparatus body 11, there is provided a sheet discharge portion 171 into which the sheet P that has undergone the fixation process in the fixing unit 16 is ejected.

In the apparatus body 11, a vertically extending sheet conveyance path 111 is further formed at a position on a right side of the image forming unit 13. A pair of conveyance rollers for conveying the sheet P is provided at an appropriate position on the sheet conveyance path 111. In addition, a pair of registration rollers for correcting skew of the sheet P and feeding the sheet P at a predetermined timing to a secondary transfer nip to be described later is also provided on an upstream side of the nip on the sheet conveyance path 111. The sheet conveyance path 111 is a conveyance path that conveys the sheet P from the sheet feeding unit 12 to the sheet discharge portion 171 via the image forming unit 13 (secondary transfer nip) and the fixing unit 16.

The sheet feeding unit 12 includes a sheet feeding tray 121 and a pickup roller 122. The sheet feeding tray 121 is detachably mounted in a lower position of the apparatus body 11, and stores a sheet bundle in which a plurality of sheets P are stacked. The pickup roller 122 feeds the uppermost sheet P of the sheet bundle stored in the sheet feeding tray 121 one by one.

The image forming unit 13 forms a toner image to be transferred onto the sheet P, and includes a plurality of image forming units for forming toner images of different colors. As these image forming units, in the present embodiment, a yellow unit 13Y using a yellow (Y) toner, a cyan unit 13C using a cyan (C) toner, a magenta unit 13M using a magenta (M) toner, and a black unit 13BK using a black (Bk) toner which are sequentially arranged according to toners of a plurality of colors from an upstream side to a downstream side in a rotation direction of an intermediate transfer belt 141, which will be described later (from a left side to a right side in FIG. 1). Each unit includes a photoreceptor drum 20, a charging device 21 disposed around the photoreceptor drum 20, a developing device 23, and a cleaning device 25. In addition, an exposure device 22 common to each unit is disposed below the image forming units.

Figure 2:
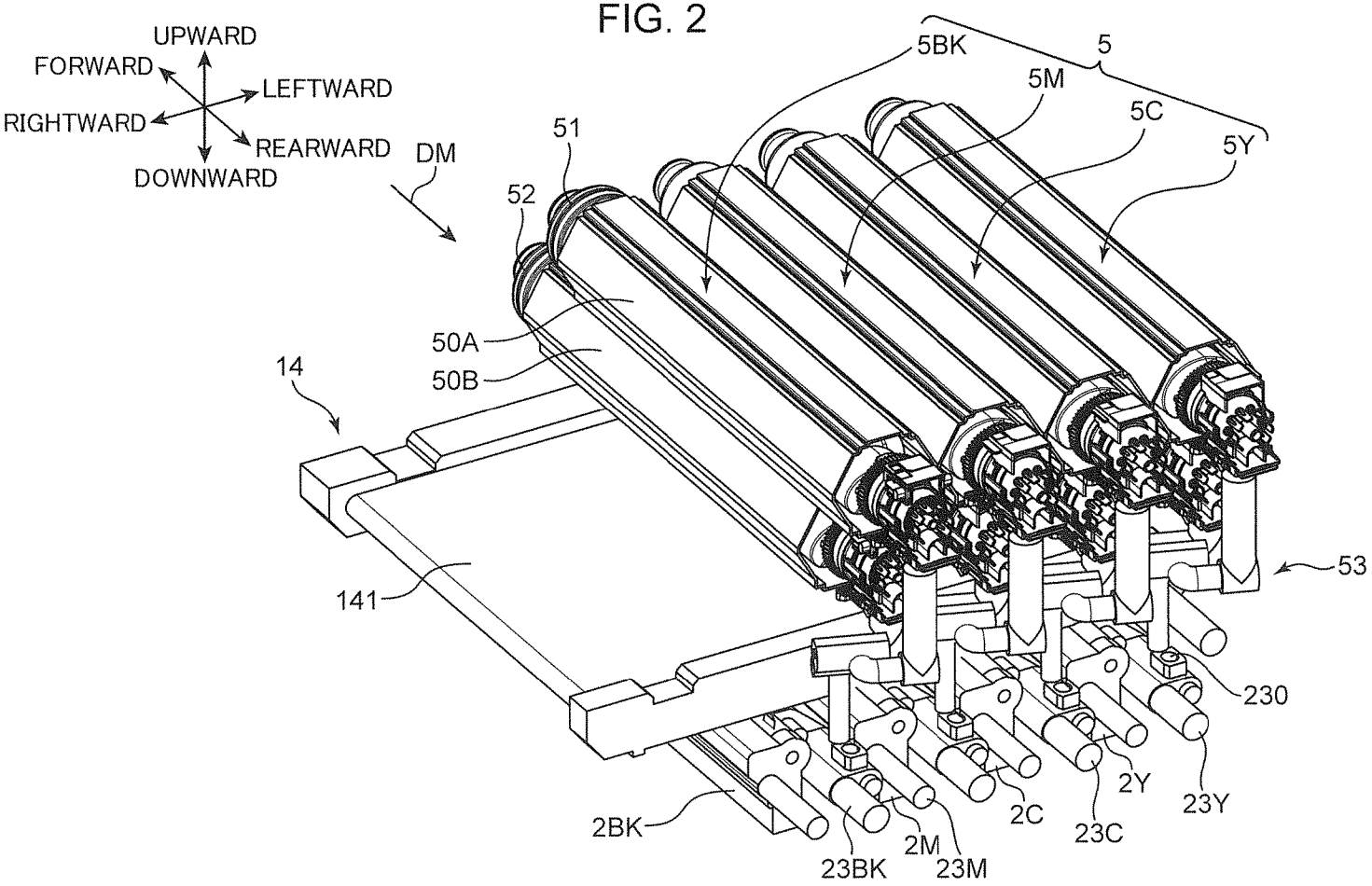
FIG. 2 is a perspective view of an image forming unit of the image forming apparatus according to the embodiment of the present disclosure.
Figure 3:
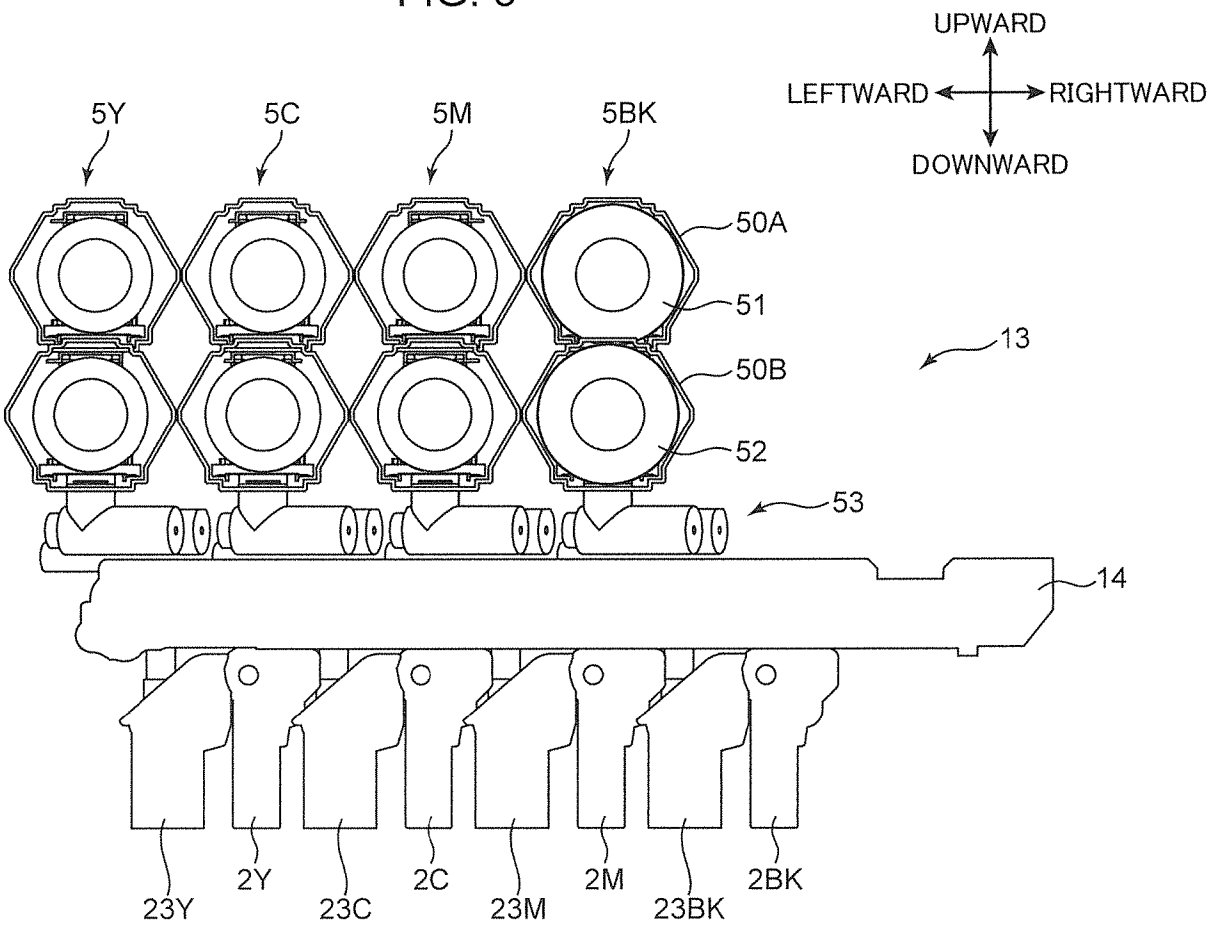
FIG. 3 is a front view of the image forming unit of the image forming apparatus according to the embodiment of the present disclosure.

The photoreceptor drum 20 is driven to rotate around a predetermined axis extending in a front-rear direction, and allows the formation of an electrostatic latent image on the peripheral surface thereof and supports the toner image. The charging device 21 uniformly charges a surface of the photoreceptor drum 20. The exposure device 22 includes various optical devices such as a light source, a polygon mirror, a reflection mirror, and a deflection mirror. The exposure device 22 forms an electrostatic latent image by irradiating the peripheral surface of the uniformly charged photoreceptor drum 20 with light modulated based on image data. The cleaning device 25 cleans the peripheral surface of the photoreceptor drum 20 after the toner image transfer. In the present embodiment, the photoreceptor drum 20, the charging device 21, and the cleaning device 25 are integrated with each other to constitute a drum unit 2 (FIGS. 1 and 2).

The developing device 23 supplies the peripheral surface of the photoreceptor drum 20 with toner in order to develop (visualize) the electrostatic latent image formed on the photoreceptor drum 20. The developing device 23 contains magnetic one-component toner as a developer. Note that in the present embodiment, the toner has a characteristic of being charged to positive polarity. In other embodiments, the developing device 23 may employ another developing method such as a two-component developer method including toner and carrier or a nonmagnetic one-component. Note that the developing device 23 includes a toner replenishing port 230 for internally receiving toner (see FIG. 2).

The intermediate transfer unit 14 is disposed above the image forming unit 13. The intermediate transfer unit 14 includes the intermediate transfer belt 141, a driving roller 142, a driven roller 143, and primary transfer rollers 24.

The intermediate transfer belt 141 is an endless belt-shaped rotating body. The intermediate transfer belt 141 is wound around the driving roller 142 and the driven roller 143 such that the peripheral surface side of the intermediate transfer belt 141 is in contact with the peripheral surface of each photoreceptor drum 20. The intermediate transfer belt 141 is driven to rotate in one direction and supports, on its surface, the toner image transferred from the photoreceptor drum 20.

The driving roller 142 stretches the intermediate transfer belt 141 on a left end side of the intermediate transfer unit 14 and drives the intermediate transfer belt 141 to rotate. The driving roller 142 is made of a metal roller. The driven roller 143 stretches the intermediate transfer belt 141 on a right end side of the intermediate transfer unit 14. The driven roller 143 applies tension to the intermediate transfer belt 141.

Each of the primary transfer rollers 24 forms a primary transfer nip together with the photoreceptor drum 20 with the intermediate transfer belt 141 interposed therebetween. The primary transfer roller 24 primarily transfers the toner image on the photoreceptor drum 20 onto the intermediate transfer belt 141. The primary transfer rollers 24 are disposed so as to face the photoreceptor drums 20 of respective colors.

The secondary transfer roller 145 is disposed facing the driving roller 142 with the intermediate transfer belt 141 interposed therebetween. The secondary transfer roller 145 is pressed against the peripheral surface of the intermediate transfer belt 141 to form the secondary transfer nip. The toner image primarily transferred onto the intermediate transfer belt 141 is secondarily transferred to the sheet P fed from the sheet feeding unit 12 in the secondary transfer nip. The intermediate transfer unit 14 and the secondary transfer roller 145 of the present embodiment constitute a transfer unit of the present disclosure. The transfer unit transfers the toner image formed in the image forming unit 13 from the photoreceptor drum 20 to the sheet P.

The sheet P fed to the fixing unit 16 is heated and pressed by passing through a fixation nip. With this operation, the toner image transferred onto the sheet P in the secondary transfer nip is fixed on the sheet P.

The sheet discharge portion 171 is formed by recessing a top portion of the apparatus body 11. The sheet P undergone the fixation process is ejected to the sheet discharge portion 171 via the sheet conveyance path 111 extending from an upper portion of the fixing unit 16.

Figure 6:
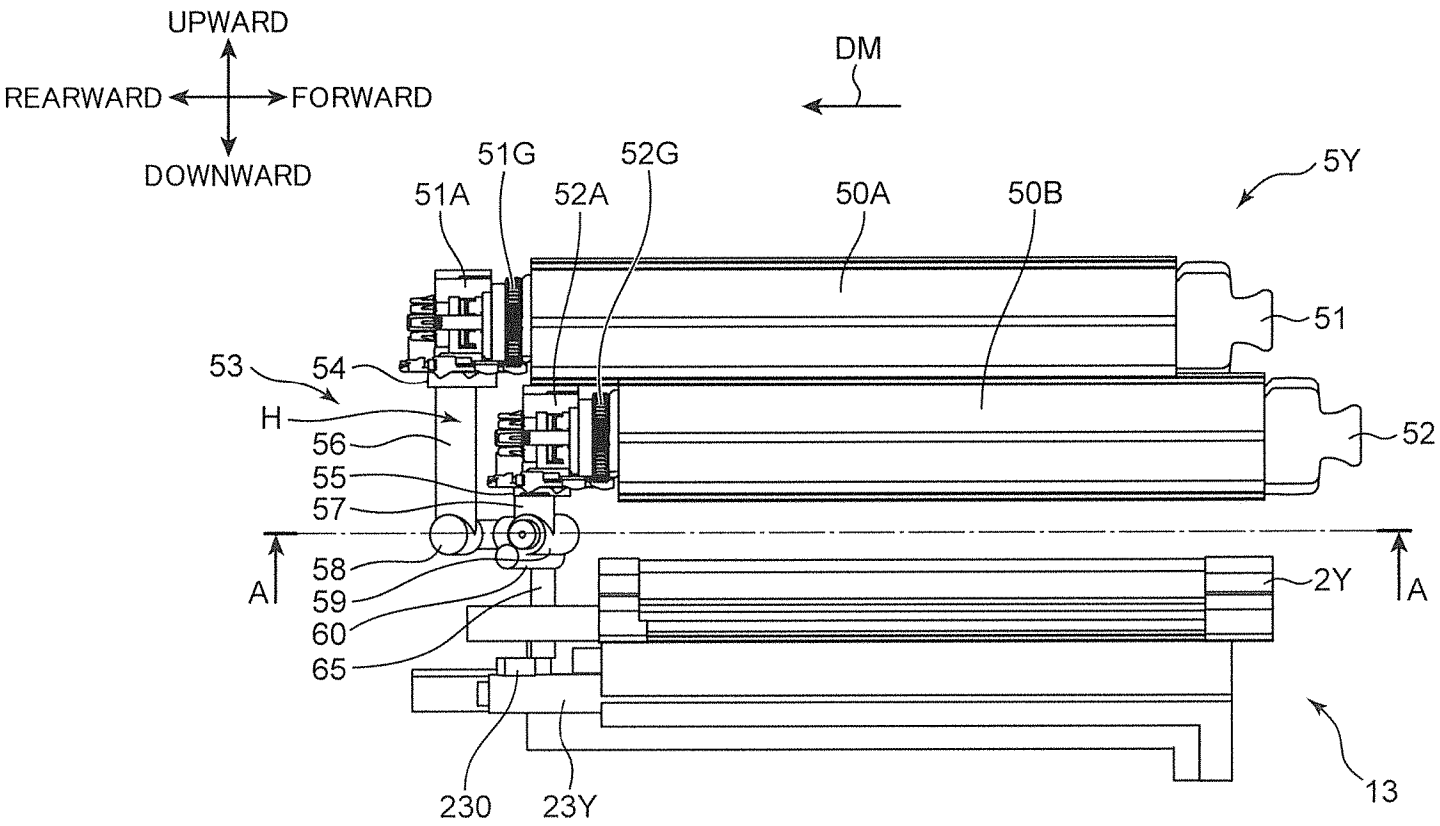
FIG. 6 is a side view of the image forming unit of the image forming apparatus according to the embodiment of the present disclosure.
Figure 7:
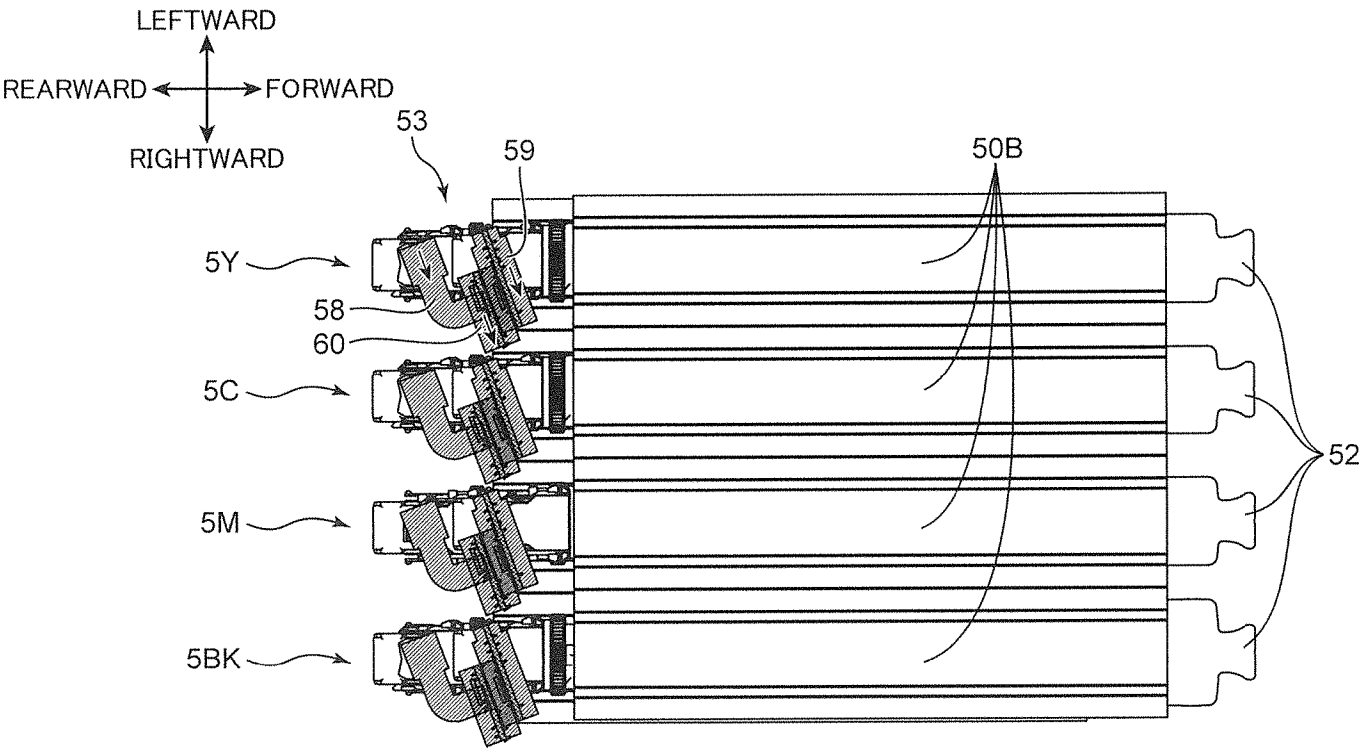
FIG. 7 is a cross-sectional view of the image forming unit of the image forming apparatus according to the embodiment of the present disclosure.

FIGS. 2 to 6 are a perspective view, a front view, a rear view, a plan view, and a side view of the image forming unit 13 of the image forming apparatus 10 according to the present embodiment, respectively. FIG. 7 is a cross-sectional view of the image forming unit 13 of the image forming apparatus according to the present embodiment, and corresponds to cross section A-A of FIG. 6 seen from below.

FIGS. 8 to 11 are a perspective view, a side view, a rear view, and a plan view of a yellow toner replenishing unit 5 and the developing device 23 of the image forming apparatus 10 according to the present embodiment.

With reference to FIGS. 2 to 11, the image forming apparatus 10 further includes the toner replenishing units 5. The toner replenishing units 5 are arranged above the developing devices 23 of respective colors and replenish the developing devices 23 with the toner through the toner replenishing ports 230. As shown in FIG. 2, in the present embodiment, the toner replenishing units 5 of respective colors (5BK, 5M, 5C, 5Y) are arranged adjacently to each other in a horizontal direction.

The toner replenishing unit 5 of each color includes an upper toner container 51 (first toner container), a lower toner container 52 (second toner container), an upper housing 50A (first container mounting unit), a lower housing 50B (second container mounting unit), a toner conveyance unit 53, an upper toner receiving unit 54 (first toner receiving unit), and a lower toner receiving unit 55 (second toner receiving unit).

Each of the upper toner container 51 and the lower toner container 52 extends along an axial direction of the photoreceptor drum 20, and can store the toner therein and discharge the toner. The upper toner container 51 and the lower toner container 52 are mounted in the apparatus body 11 of the image forming apparatus 10 along a mounting direction in the axial direction of the photoreceptor drum 20 (arrow DM in FIG. 2). In the present embodiment, each of the upper toner container 51 and the lower toner container 52 has a cylindrical shape, and a helical groove extending helically along the axial direction is formed on the outer peripheral surface thereof. The helical groove forms a helical protrusion protruding into space inside the upper toner container 51 and the lower toner container 52. As will be described later, when the upper toner container 51 and the lower toner container 52 are rotated, the internal toner is conveyed rearward by the helical protrusions. The upper toner container 51 includes a fixed unit 51A and a first container gear 51G (FIG. 6). The fixed unit 51A engages with the upper toner receiving unit 54 and delivers the toner in the upper toner container 51 to the upper toner receiving unit 54. Note that the fixed unit 51A does not rotate. Of the upper toner container 51, a portion forward of the fixed unit 51A is relatively rotatable with respect to the fixed unit 51A. The first container gear 51G is a gear fixed to an outer peripheral portion of the upper toner container 51 forward of the fixed unit 51A. When rotational force is transmitted to the first container gear 51G, a forward portion of the upper toner container 51 rotates.

Similarly, the lower toner container 52 includes a fixed unit 52A and a second container gear 52G (FIG. 6). The fixed unit 52A engages with the lower toner receiving unit 55 and delivers the toner in the lower toner container 52 to the lower toner receiving unit 55. Note that the fixed unit 52A does not rotate. Of the lower toner container 52, a portion forward of the fixed unit 52A is relatively rotatable with respect to the fixed unit 52A. The second container gear 52G is a gear fixed to an outer peripheral portion of the lower toner container 52 forward of the fixed unit 52A. When rotational force is transmitted to the second container gear 52G, a forward portion of the lower toner container 52 rotates.

Note that the upper toner container 51 includes a first toner discharge port 511 (FIG. 9) formed on a leading end side (fixed unit 51A) in the mounting direction with respect to the upper housing 50A. The lower toner container 52 includes a second toner discharge port 521 (FIG. 9) formed on a leading end side (fixed unit 52A) in the mounting direction with respect to the lower housing 50B. The toner is discharged from these toner discharge ports. Note that the upper toner container 51 and the lower toner container 52 include shutters (not shown) that seal the toner discharge ports. When the upper toner container 51 and the lower toner container 52 are mounted in the upper housing 50A and the lower housing 50B, respectively, these shutters are slid to open the toner discharge ports. In the present embodiment, the upper toner container 51 and the lower toner container 52 have the same shape. In other words, the toner container of each color applied to the image forming apparatus 10 can be mounted in the upper housing 50A or the lower housing 50B in the toner replenishing unit 5 of the corresponding color. Note that the upper toner container 51 and the lower toner container 52 are disposed in container space S of FIG. 1.

The upper housing 50A is disposed with a space above the developing device 23 in the apparatus body 11. The upper housing 50A allows the upper toner container 51 to be mounted inside the upper housing 50A along the mounting direction DM, and receives the upper toner container 51. The lower housing 50B is disposed above the developing device 23 and below (immediately under) the upper housing 50A in the apparatus body 11. The lower housing 50B allows the lower toner container 52 to be mounted inside the lower housing 50B along the mounting direction DM, and receives the lower toner container 52.

With reference to FIG. 6, in the present embodiment, the lower housing 50B positions the lower toner container 52 in the apparatus body 11 such that with respect to a leading end portion (rear end portion) of the upper toner container 51 mounted in the upper housing 50A in the mounting direction, the leading end portion (rear end portion) of the lower toner container 52 in the mounting direction is disposed with a predetermined space on the trailing end side (front side) in the mounting direction. As a result, a container step portion H (FIG. 6) is formed in a space below the upper toner container 51, the space being between the leading end portion in the mounting direction of the upper toner container 51 and the leading end portion in the mounting direction of the lower toner container 52.

The toner conveyance unit 53 conveys the toner discharged from the upper toner container 51 mounted in the upper housing 50A and the lower toner container 52 mounted in the lower housing 50B to the developing device 23. As will be described later, part of the toner conveyance unit 53 is disposed in the container step portion H described above.

Figure 9:
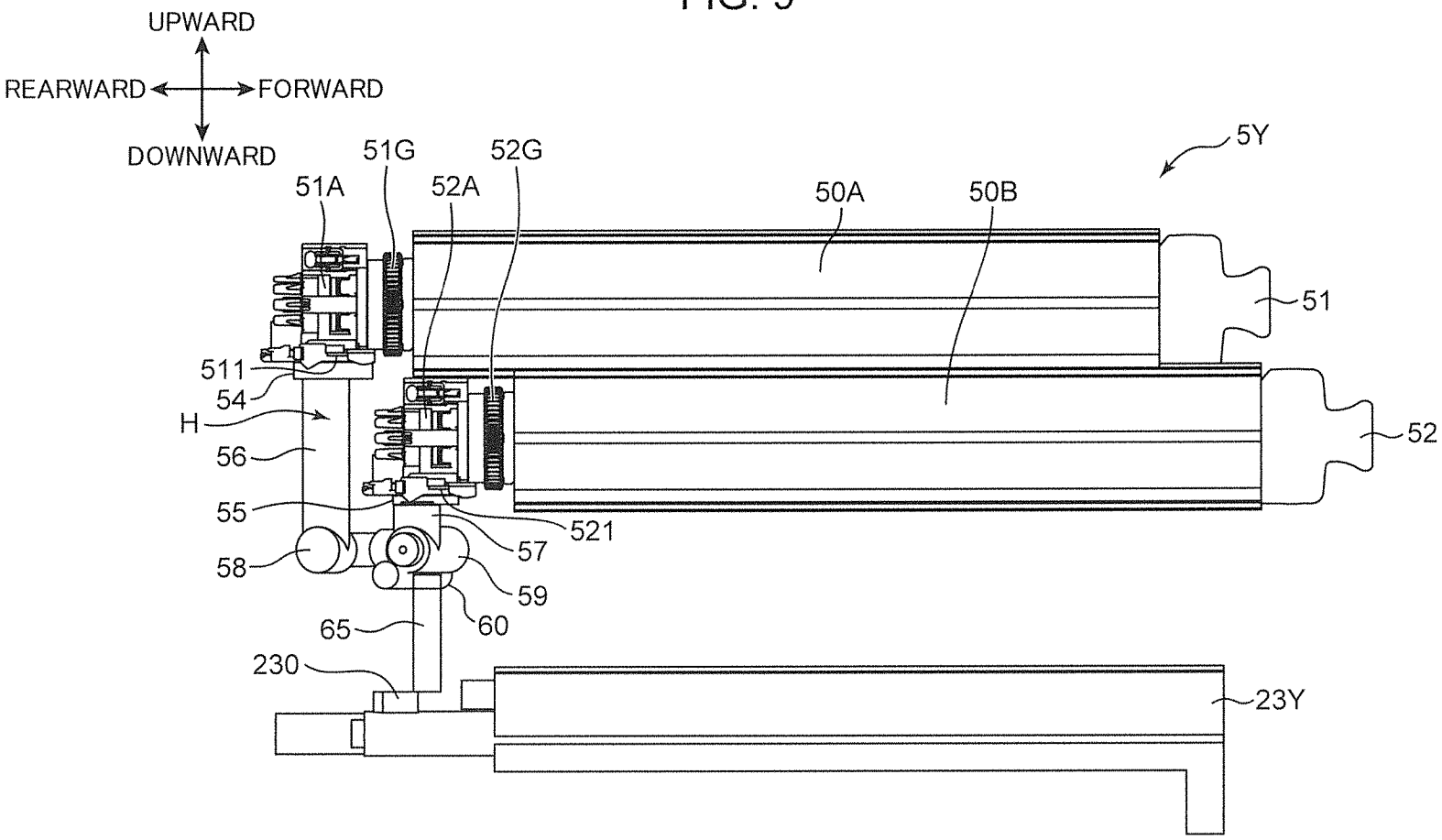
FIG. 9 is a side view of the toner replenishing unit and the developing device of the image forming apparatus according to the embodiment of the present disclosure.

The upper toner receiving unit 54 is disposed closer to the leading end side in the mounting direction than the upper housing 50A is. The upper toner receiving unit 54 engages with the leading end portion of the upper toner container 51 in the mounting direction (fixed unit 51A). The upper toner receiving unit 54 receives the toner discharged from the first toner discharge port 511 of the upper toner container 51 (FIG. 9).

The lower toner receiving unit 55 is disposed closer to the leading end side in the mounting direction than the lower housing 50B is. The lower toner receiving unit 55 engages with the leading end portion of the lower toner container 52 in the mounting direction (fixed unit 52A). The lower toner receiving unit 55 receives the toner discharged from the second toner discharge port 521 of the lower toner container 52 (FIG. 9).

Furthermore, the toner conveyance unit 53 includes a first vertical conveyance unit 56 (first longitudinal conveyance unit), a second vertical conveyance unit 57 (second longitudinal conveyance unit), a first horizontal conveyance unit 58 (first lateral conveyance unit), a second horizontal conveyance unit 59 (second lateral conveyance unit), a toner storage unit 60 (joining conveyance unit), and a third vertical conveyance unit 65 (toner supply unit).

The first vertical conveyance unit 56 is a pipe-shaped member disposed closer to the leading end side in the mounting direction than the lower toner receiving unit 55 is. In other words, the first vertical conveyance unit 56 is disposed in the container step portion H. The first vertical conveyance unit 56 extends downward from the upper toner receiving unit 54 and conveys the toner downward. Therefore, the upper toner receiving unit 54 and the first vertical conveyance unit 56 communicate with each other.

The second vertical conveyance unit 57 is a pipe-shaped member disposed below the lower toner receiving unit 55. The second vertical conveyance unit 57 extends downward from the lower toner receiving unit 55 and conveys the toner downward. Therefore, the lower toner receiving unit 55 and the second vertical conveyance unit 57 communicate with each other.

The first horizontal conveyance unit 58 is a horizontally extending pipe-shaped member. The first horizontal conveyance unit 58 receives the toner from the first vertical conveyance unit 56 and delivers the toner to the toner storage unit 60 through part of the second horizontal conveyance unit 59 while conveying the toner diagonally forward along the horizontal direction.

The second horizontal conveyance unit 59 is a horizontally extending pipe-shaped member. The second horizontal conveyance unit 59 receives the toner from the second vertical conveyance unit 57 and delivers the toner to the toner storage unit 60 while conveying the toner diagonally forward along the horizontal direction.

The toner storage unit 60 is a pipe-shaped member. The toner storage unit 60 receives the toner such that the toner conveyed by the first vertical conveyance unit 56 and the second vertical conveyance unit 57 join through the first horizontal conveyance unit 58 and the second horizontal conveyance unit 59. Also, the toner storage unit 60 further conveys the toner along the horizontal direction. Note that as shown in FIGS. 6 and 9, the toner storage unit 60 is disposed closer to the trailing end side in the mounting direction than the leading end portion of the upper toner container 51 in the mounting direction is.

The third vertical conveyance unit 65 is a pipe-shaped member. The third vertical conveyance unit 65 extends downward from the toner storage unit 60 and supplies the toner replenishing port 230 of the developing device 23 with the toner. Therefore, the third vertical conveyance unit 65 communicates with the toner storage unit 60 and the developing device 23. Note that in the drawings, the positions of the third vertical conveyance unit 65 and the toner replenishing port 230 are slightly displaced from each other for description.

Note that conveyance screws (not shown) capable of conveying the toner in the horizontal direction by rotating are disposed inside the first horizontal conveyance unit 58, the second horizontal conveyance unit 59, and the toner storage unit 60. In a case where the toner storage unit 60 is filled with the toner, a replenishment amount of the developing device 23 with toner is determined depending on a rotation amount of the conveyance screw. In the present embodiment, the conveyance member as described above is not disposed inside the first vertical conveyance unit 56, the second vertical conveyance unit 57, and the third vertical conveyance unit 65. In other embodiments, however, an agitating member that rotates or moves up and down may be disposed to prevent aggregation of the toner in the conveyance units.

Figure 10:
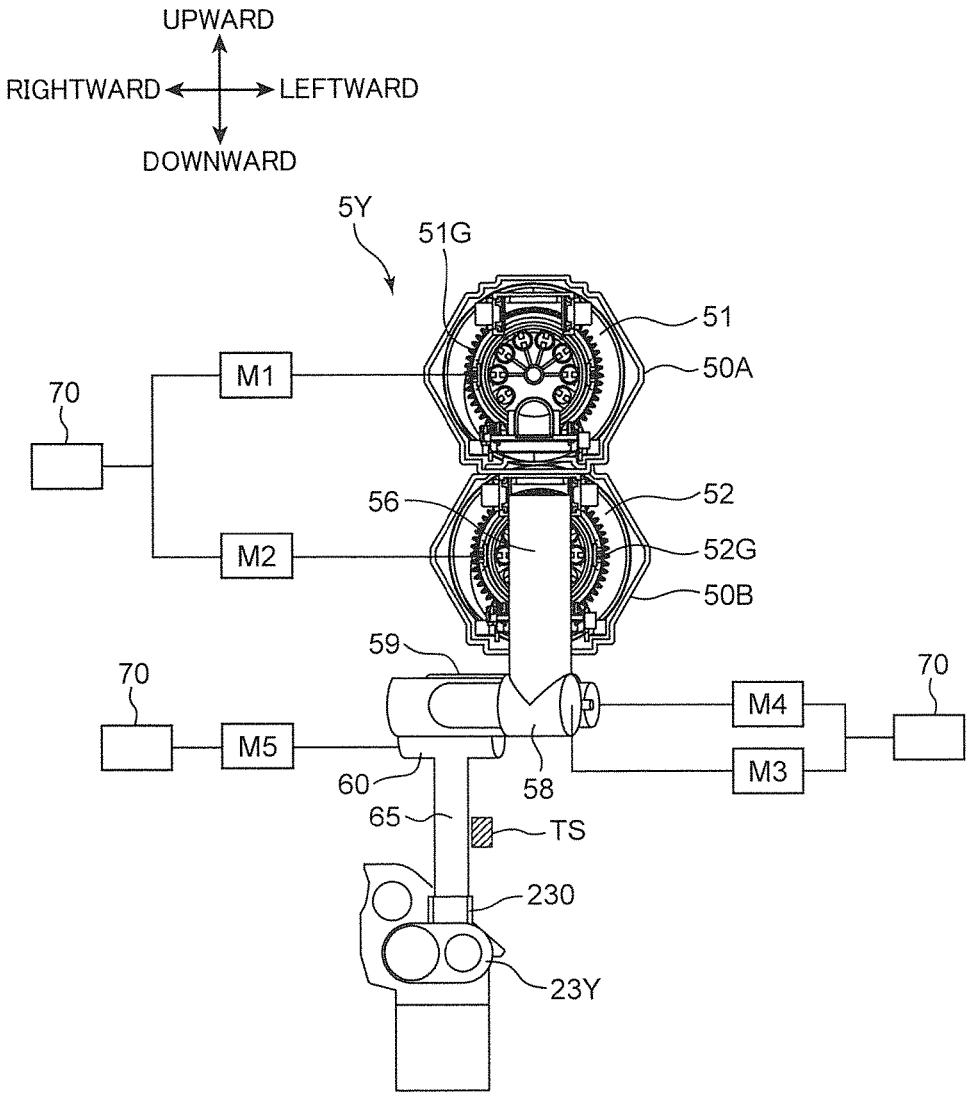
FIG. 10 is a rear view of the toner replenishing unit and the developing device of the image forming apparatus according to the embodiment of the present disclosure.
Figure 11:
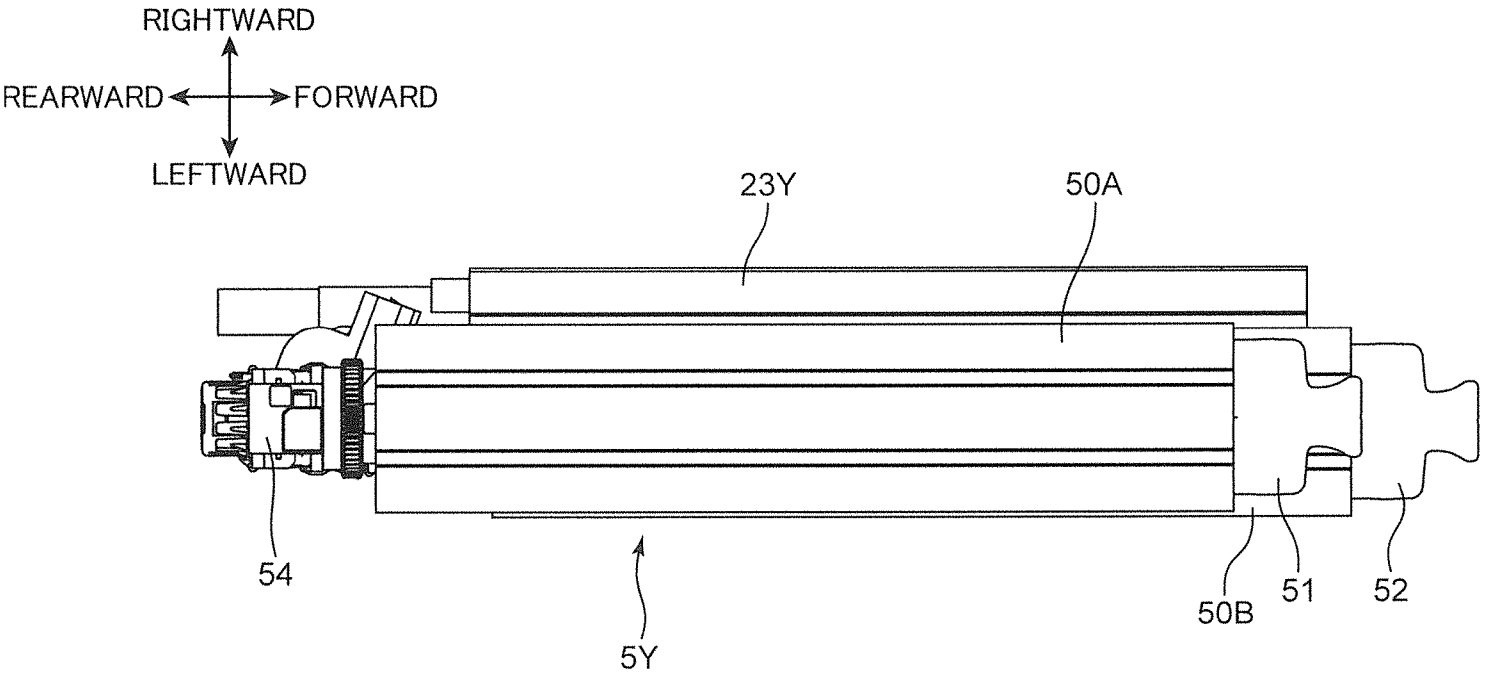
FIG. 11 is a plan view of the toner replenishing unit and the developing device of the image forming apparatus according to the embodiment of the present disclosure.

Furthermore, the toner replenishing unit 5 includes a first motor M1, a second motor M2, a third motor M3, a fourth motor M4, a fifth motor M5, a toner sensor TS, and a replenishment control unit 70 (FIG. 10).

The first motor M1 generates a rotational driving force for rotating the upper toner container 51. A motor shaft (not shown) of the first motor M1 is coupled to the first container gear 51G of the upper toner container 51 (FIG. 10).

The second motor M2 generates a rotational driving force for rotating the lower toner container 52. A motor shaft (not shown) of the second motor M2 is coupled to the second container gear 52G of the lower toner container 52 (FIG. 10).

The third motor M3 generates a rotational driving force for rotating the conveyance screw disposed in the first horizontal conveyance unit 58. Similarly, the fourth motor M4 generates a rotational driving force for rotating the conveyance screw disposed in the second horizontal conveyance unit 59. The fifth motor M5 generates a rotational driving force for rotating the conveyance screw disposed in the toner storage unit 60.

The toner sensor TS is disposed facing the third vertical conveyance unit 65. The toner sensor TS includes a magnetic permeability sensor and detects the toner with which the third vertical conveyance unit 65 is filled. When sufficient toner exists inside the third vertical conveyance unit 65, the toner sensor TS outputs a HIGH signal (+5V). On the other hand, when almost no toner exists inside the third vertical conveyance unit 65, the toner sensor TS outputs a LOW signal (0V). Note that in other embodiments, the toner sensor TS may be a PI sensor (photosensor). In this case, the third vertical conveyance unit 65 is formed of a transparent pipe member, and the PI sensor detects whether there is toner in the third vertical conveyance unit 65.

The replenishment control unit 70 controls the rotation of the first motor M1, the second motor M2, the third motor M3, the fourth motor M4, and the fifth motor M5. In particular, the replenishment control unit 70 controls each motor in response to output of the toner sensor TS. As one example, the replenishment control unit 70 controls each motor of the toner replenishing unit 5 such that one toner container of the upper toner container 51 and the lower toner container 52 supplies the developing device 23 with the toner, and when the one toner container becomes empty, the other toner container of the upper toner container 51 and the lower toner container 52 supplies the developing device 23 with the toner. The upper toner container 51 and the lower toner container 52 being empty of toner (toner empty) may be detected with rotation time of the upper toner container 51 and the lower toner container 52, or may be detected with output of the toner sensor TS. First, the toner is supplied from the upper toner container 51 to the developing device 23 by rotating the first motor M1, the third motor M3, and the fifth motor M5. After a while, in a case where the toner sensor TS continues to output the LOW signal although the upper toner container 51 is being rotated, the replenishment control unit 70 determines that the upper toner container 51 has become empty and switches toner replenishment from the upper toner container 51 to the lower toner container 52. That is, the replenishment control unit 70 supplies the toner from the lower toner container 52 to the developing device 23 by rotating the second motor M2, the fourth motor M4, and the fifth motor M5.

As described above, in the present embodiment, two toner containers are disposed with respect to the developing device 23 in the apparatus body 11. The upper toner container 51 and the lower toner container 52 are adjacently disposed in the vertical direction in the apparatus body 11. Therefore, as compared with a case where two toner containers are adjacently disposed in the horizontal direction, an increase in horizontal width of the apparatus body 11 is inhibited. Also, the replenishment control unit 70 controls a drive system of the toner replenishing unit 5 such that one toner container of the upper toner container 51 and the lower toner container 52 supplies the developing device 23 with the toner, and when the one toner container becomes empty, the other toner container of the upper toner container 51 and the lower toner container 52 supplies the developing device 23 with the toner. Therefore, even when the upper toner container 51 becomes empty, the lower toner container 52 promptly enables execution of an image forming operation. As a result, it is possible to reduce the frequency and time at which the image forming operation stops following replacement of the toner container.

In the present embodiment, the upper toner container 51 and the lower toner container 52 are disposed at positions displaced from each other in the mounting direction in the apparatus body 11. It is possible to efficiently dispose the toner replenishing unit 5 (toner conveyance unit 53) by using the container step portion H formed by the two toner containers.

In the present embodiment, the first vertical conveyance unit 56 is provided to convey downward the toner discharged from the upper toner container 51 located above the lower toner container 52. The first vertical conveyance unit 56 can be disposed by using the container step portion H. Therefore, as compared with a case where the positions of the upper toner container 51 and the lower toner container 52 in the mounting direction are identical, a space for disposing the first vertical conveyance unit 56 can be reduced.

Furthermore, in the present embodiment, the toner replenishing unit 5 includes the first horizontal conveyance unit 58 and the second horizontal conveyance unit 59. Therefore, as compared with a case where the toner flows directly from the first vertical conveyance unit 56 and the second vertical conveyance unit 57 into the toner storage unit 60, it is possible to stably fill the toner storage unit 60 with the toner by conveyance forces of the conveyance screws of the first horizontal conveyance unit 58 and the second horizontal conveyance unit 59. As a result, replenishment of the developing device 23 with the toner via the third vertical conveyance unit 65 can be stably executed.

Furthermore, in the present embodiment, the toner storage unit 60 is disposed closer to the trailing end side in the mounting direction than the leading end portion of the upper toner container 51 in the mounting direction is. Therefore, as compared with a case where the toner storage unit 60 is located closer to the leading end side in the mounting direction than the upper toner container 51 is, it is possible to reduce the size of the apparatus body 11 in the mounting direction.

In the present embodiment, the image forming unit 13 includes a plurality of image forming units 13BK, 13M, 13C, and 13Y arranged according to the toners of the plurality of colors. The upper toner containers 51 of the plurality of image forming units are arranged adjacently to each other in the horizontal direction. The lower toner containers 52 of the plurality of image forming units are arranged adjacently to each other in the horizontal direction. Therefore, even in a case where an image is formed on the sheet P with the toners of the plurality of colors, the frequency at which the image forming operation stops following replacement of the toner container is reduced and the increase in a width of the apparatus body 11 in a direction horizontal and orthogonal to a rotation axis of the photoreceptor drum 20 is inhibited. As shown in FIG. 2, the intermediate transfer unit 14 is disposed by using a height at which the toner is replenished from the upper toner container 51 and the lower toner container 52 of each color to the developing device 23. In other words, the toner replenishing units 5 of respective colors are disposed using the positions above and behind the intermediate transfer unit 14.

Figure 4:
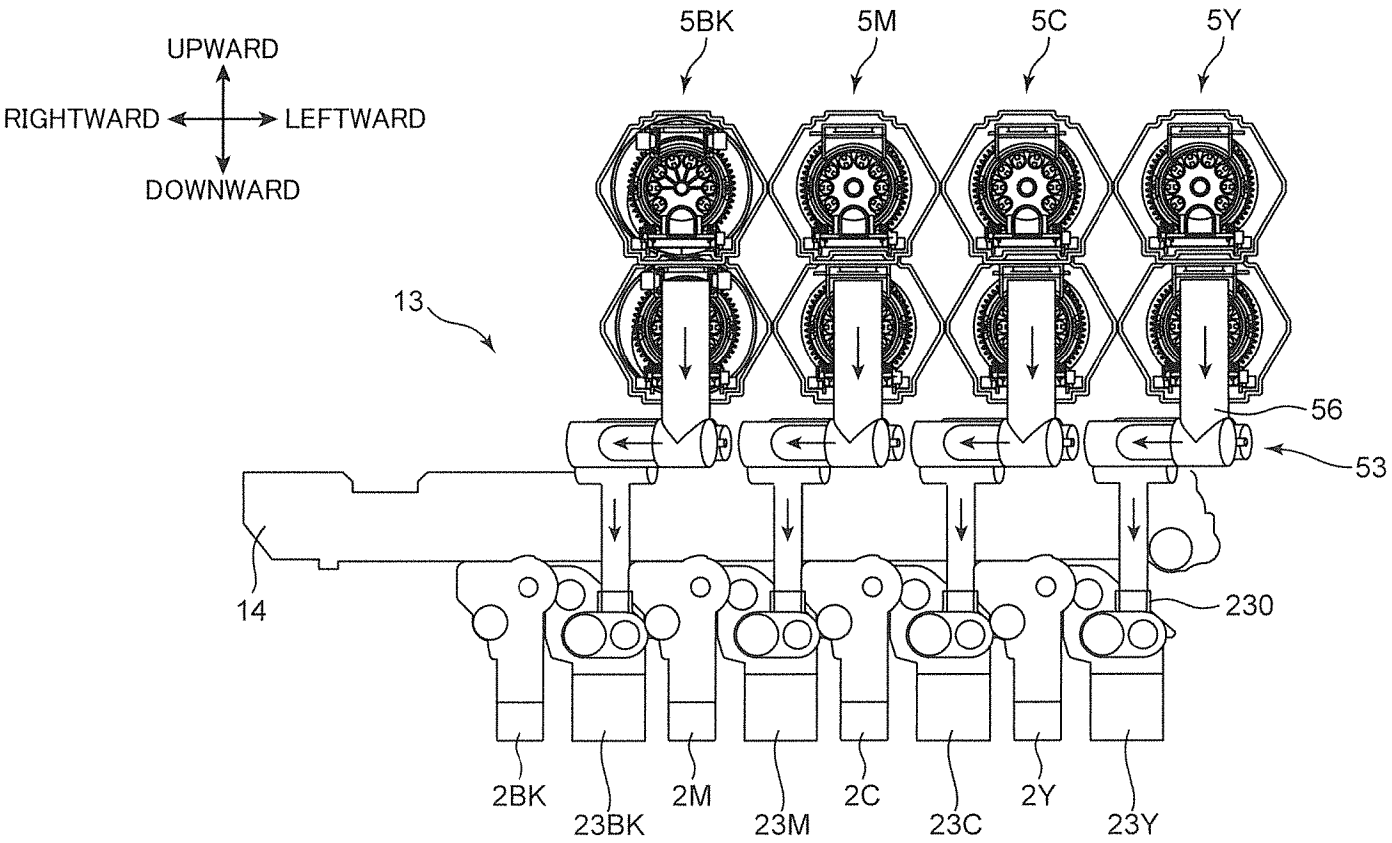
FIG. 4 is a rear view of the image forming unit of the image forming apparatus according to the embodiment of the present disclosure.
Figure 5:
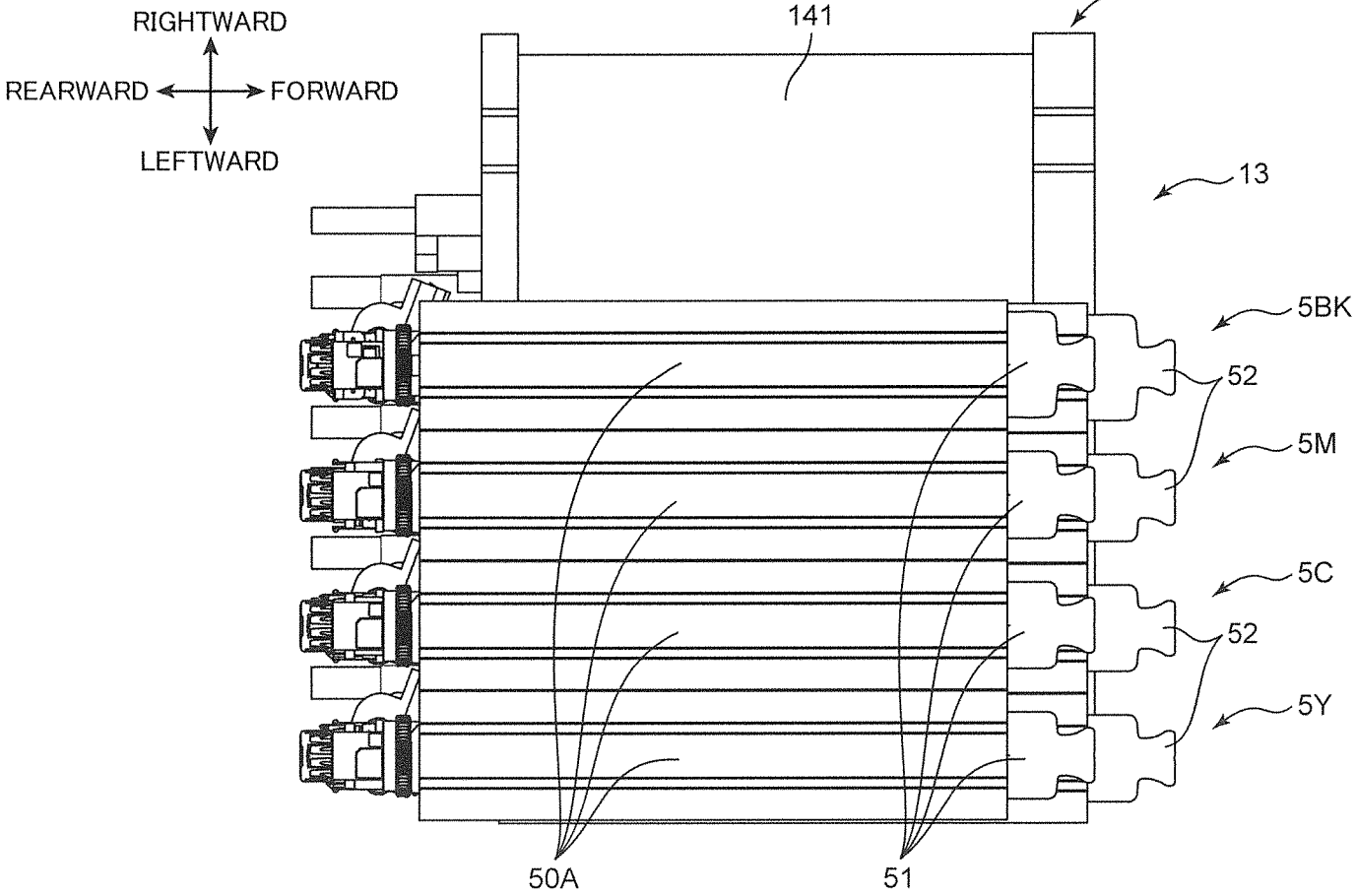
FIG. 5 is a plan view of the image forming unit of the image forming apparatus according to the embodiment of the present disclosure.

As shown in FIGS. 2 and 4, in the toner replenishing units 5BK, 5M, and 5C, the adjacent drum unit 2 (photoreceptor drum 20) of another color is disposed immediately under the first vertical conveyance unit 56. In order to replenish, with the toner, the toner replenishing port 230 of the developing device 23 corresponding to the color of the toner replenishing unit located rightward from the position immediately under the first vertical conveyance unit 56, the first horizontal conveyance unit 58, the second horizontal conveyance unit 59, and the toner storage unit 60 convey the toner in the horizontal direction. At this time, the replenishment amount of the developing device 23 with toner is stably maintained by filling the toner storage unit 60 with toner.

The image forming apparatus 10 according to the embodiment of the present disclosure has been described in detail above. With such a configuration, there is provided an image forming apparatus that reduces the frequency and time at which the image forming operation stops following replacement of the toner container, and inhibits the horizontal width of the apparatus body 11 from increasing. Note that the present disclosure is not limited to this configuration. The present disclosure can take, for example, the following variations.

Figure 8:
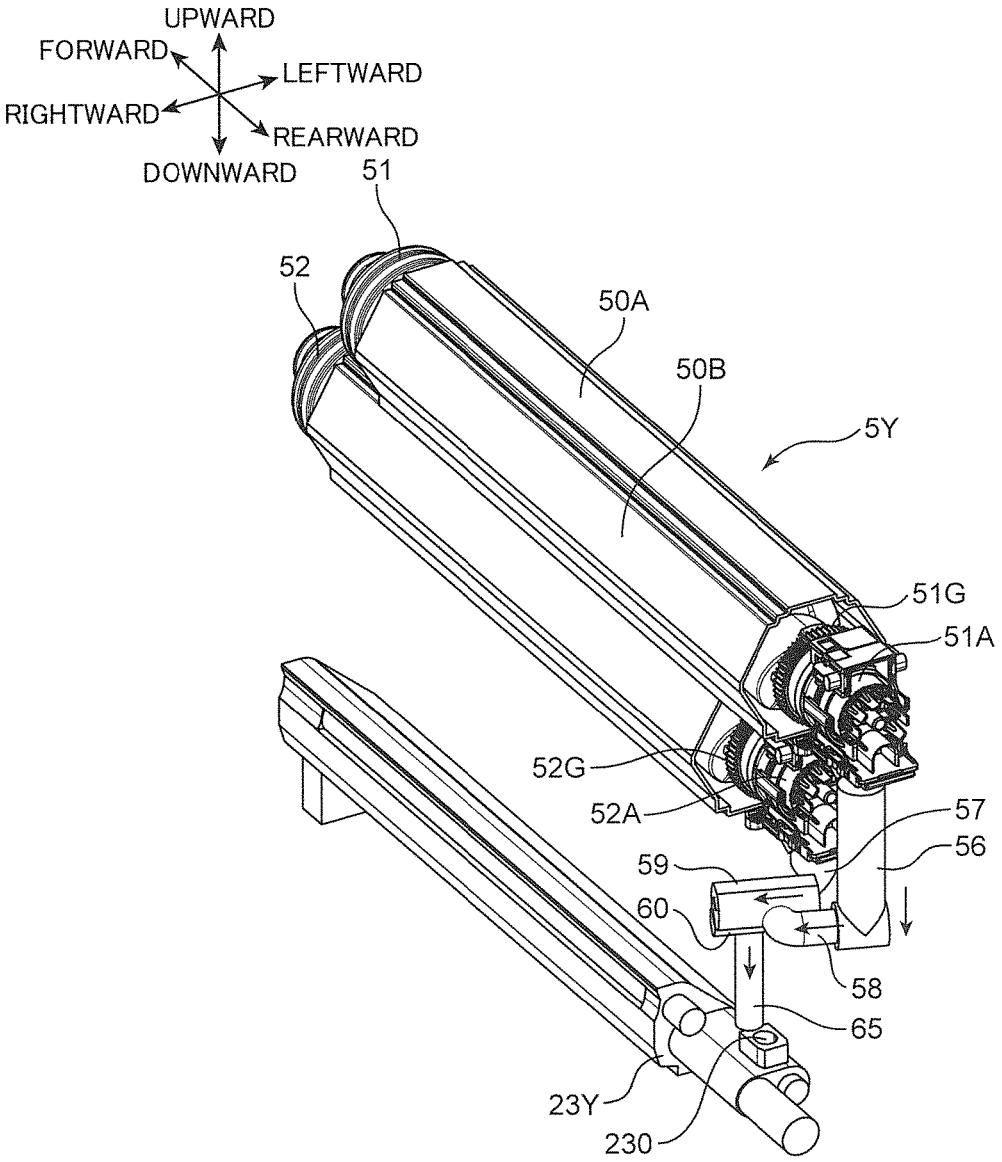
FIG. 8 is a perspective view of a toner replenishing unit and a developing device of the image forming apparatus according to the embodiment of the present disclosure.

(1) The above-described embodiment has described an aspect in which the toner replenishing units 5 and the developing devices 23 are disposed for the four-color toners. However, the present disclosure may be applied to a monochrome image forming apparatus having a structure as shown in FIG. 8.

(2) The above-described embodiment has described an aspect in which the upper toner container 51 and the lower toner container 52 convey the toner therein by rotating main body portions of the containers. However, the toner containers may include rotatable toner conveyance members therein such as screws.

Figure 12:
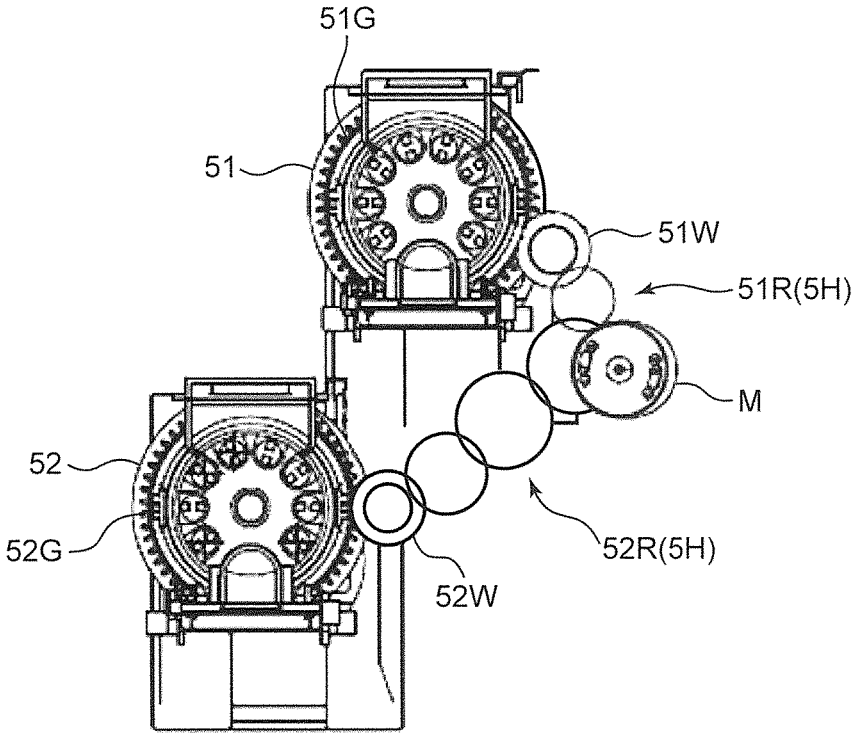
FIG. 12 is a rear view of a drive system that rotates toner containers of an image forming apparatus according to a variation of the present disclosure.

(3) The above-described embodiment has described an aspect in which the first motor M1 rotating the upper toner container 51 and the second motor M2 rotating the lower toner container 52 are provided. However, the present disclosure is not limited to this aspect. FIG. 12 is a rear view showing a drive system that rotates the upper toner container 51 and the lower toner container 52 among the toner replenishing units according to the variations of the present disclosure. Note that for description, FIG. 12 shows positions of the upper toner container 51 and the lower toner container 52 displaced in the horizontal direction. The toner replenishing unit includes a motor M and a drive transmission unit 5H. The motor M is rotatable in a first rotation direction and a second rotation direction opposite to the first rotation direction, and generates a rotational driving force. The drive transmission unit 5H includes a first transmission unit 51R and a second transmission unit 52R, which are coupled to the motor M. The first transmission unit 51R transmits the rotational driving force of the motor M to the first container gear 51G of the upper toner container 51.

Meanwhile, the second transmission unit 52R transmits the rotational driving force of the motor M to the second container gear 52G of the lower toner container 52. The first transmission unit 51R and the second transmission unit 52R have one-way clutches 51W and 52W, respectively.

With this configuration, when the motor M is rotated in the first rotation direction, by transmitting the rotational driving force to the upper toner container 51, the drive transmission unit 5H allows the toner to be discharged from the first toner discharge port 511 of the upper toner container 51. At this time, the rotation of the lower toner container 52 is restricted by the one-way clutch 52W. Therefore, the toner is not replenished from the lower toner container 52. Meanwhile, when the motor M is rotated in the second rotation direction, by transmitting the rotational driving force to the lower toner container 52, the drive transmission unit 5H allows the toner to be discharged from the second toner discharge port 521 of the lower toner container 52. At this time, the rotation of the upper toner container 51 is restricted by the one-way clutch 51W. Therefore, the toner is not replenished from the upper toner container 51. In this way, it is possible to selectively supply the toner from the upper toner container 51 and the lower toner container 52 by the single first motor M1 and the drive transmission unit 5H.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

an apparatus body;

at least one image forming unit configured to form a toner image; and a transfer unit configured to transfer the toner image onto a sheet, wherein the image forming unit includes:

a photoreceptor drum rotated about a predetermined axis and having a peripheral surface that allows formation of an electrostatic latent image and supports the toner image corresponding to the electrostatic latent image;

a developing device configured to supply the photoreceptor drum with toner to visualize the electrostatic latent image in the toner image, the developing device including a toner replenishing port for internally receiving the toner; and a toner replenishing unit disposed above the developing device and configured to replenish the developing device with the toner through the toner replenishing port, the toner replenishing unit includes:

a first toner container extending along an axial direction of the photoreceptor drum and configured to store and discharge the toner;

a second toner container extending along the axial direction and configured to store and discharge the toner;

a first container mounting unit disposed with a space above the developing device in the apparatus body, the first container mounting unit allowing the first toner container to be mounted along the axial direction and receiving the first toner container;

a second container mounting unit disposed above the developing device and below the first container mounting unit in the apparatus body, the second container mounting unit allowing the second toner container to be mounted along the axial direction and receiving the second toner container;

a toner conveyance unit configured to convey the toner discharged from the first toner container mounted in the first container mounting unit and the second toner container mounted in the second container mounting unit to the developing device; and a replenishment control unit configured to control the toner conveyance unit such that one toner container of the first toner container and the second toner container supplies the developing device with the toner, and when the one toner container becomes empty, another toner container of the first toner container and the second toner container supplies the developing device with the toner.

2. The image forming apparatus according to claim 1, wherein the first toner container includes a first toner discharge port formed on a leading end side in a mounting direction with respect to the first container mounting unit, the second toner container includes a second toner discharge port formed on the leading end side in the mounting direction with respect to the second container mounting unit, the second container mounting unit positions the second toner container in the apparatus body such that with respect to the leading end portion in the mounting direction of the first toner container mounted in the first container mounting unit, the leading end portion in the mounting direction of the second toner container is disposed with a predetermined space on a trailing end side of the mounting direction, part of the toner conveyance unit is disposed in a container step portion formed in space below the first toner container, the space being between the leading end portion of the first toner container in the mounting direction and the leading end portion of the second toner container in the mounting direction.

3. The image forming apparatus according to claim 2, wherein the toner conveyance unit includes:

a first toner receiving unit engaged with the leading end portion of the first toner container in the mounting direction, the first toner receiving unit being configured to receive the toner discharged from the first toner discharge port;

a second toner receiving unit engaged with the leading end portion of the second toner container in the mounting direction, the second toner receiving unit being configured to receive the toner discharged from the second toner discharge port;

a first longitudinal conveyance unit extending downward from the first toner receiving unit so as to be disposed in the container step portion, the first longitudinal conveyance unit being configured to convey the toner downward;

a second longitudinal conveyance unit extending downward from the second toner receiving unit, the second longitudinal conveyance unit being configured to convey the toner downward;

a joining conveyance unit configured to receive the toner such that the toner conveyed by the first longitudinal conveyance unit and the second longitudinal conveyance unit join, the joining conveyance unit being further configured to convey the toner along a horizontal direction; and a toner supply unit extending downward from the joining conveyance unit, the toner supply unit being configured to supply the developing device with the toner.

4. The image forming apparatus according to claim 3, wherein the toner conveyance unit further includes:

a first lateral conveyance unit configured to receive the toner from the first longitudinal conveyance unit, the first lateral conveyance unit being configured to deliver the toner to the joining conveyance unit while conveying the toner along the horizontal direction; and a second lateral conveyance unit configured to receive the toner from the second longitudinal conveyance unit, the second lateral conveyance unit being configured to deliver the toner to the joining conveyance unit while conveying the toner along the horizontal direction.

5. The image forming apparatus according to claim 3, wherein the joining conveyance unit is disposed closer to a trailing end side in the mounting direction than the leading end portion in the mounting direction of the first toner container is.

6. The image forming apparatus according to claim 2, further comprising:

a motor rotatable in a first rotation direction and a second rotation direction opposite to the first rotation direction, the motor generating a rotational driving force; and a drive transmission unit coupled to the motor, the drive transmission unit allowing the toner to be discharged from the first toner discharge port by transmitting the rotational driving force to the first toner container when the motor is rotated in the first rotation direction, the drive transmission unit allowing the toner to be discharged from the second toner discharge port by transmitting the rotational driving force to the second toner container when the motor is rotated in the second rotation direction.

7. The image forming apparatus according to claim 1, wherein the at least one image forming unit includes a plurality of image forming units arranged corresponding to the toner of a plurality of colors, the first toner containers of the plurality of image forming units are arranged adjacently to each other in a horizontal direction, and the second toner containers of the plurality of image forming units are arranged adjacently to each other in the horizontal direction.

* * * * *